US007497328B2

(12) United States Patent
Tonelli

(10) Patent No.: US 7,497,328 B2
(45) Date of Patent: Mar. 3, 2009

(54) PORTABLE CONTAINER PARTICULARLY FOR PROFESSIONAL EQUIPMENT AND INSTRUMENTS

(75) Inventor: Massimo Tonelli, Casalecchio di Reno (IT)

(73) Assignee: GT Line S.r.l., Crespellano (IT)

( * ) Notice: Subject to any disclaimer, the term of this patent is extended or adjusted under 35 U.S.C. 154(b) by 398 days.

(21) Appl. No.: 11/217,601

(22) Filed: Sep. 2, 2005

(65) Prior Publication Data

US 2006/0060588 A1 Mar. 23, 2006

(30) Foreign Application Priority Data

Sep. 17, 2004 (IT) ..... BO2004A0574

(51) Int. Cl.
*B65D 85/38* (2006.01)

(52) U.S. Cl. ..... 206/305; 206/349; 220/554; 312/902

(58) Field of Classification Search ..... 206/305, 206/349; 220/23.4, 23.87, 23.89, 23.9, 528, 220/529, 553, 554; 248/207, 213.2; 312/902; 361/683

See application file for complete search history.

(56) References Cited

U.S. PATENT DOCUMENTS

| | | | | |
|---|---|---|---|---|
| 2,541,890 | A * | 2/1951 | Schaperkotter et al. | 312/902 |
| 5,441,707 | A * | 8/1995 | Lewis et al. | 220/23.86 |
| 6,105,767 | A * | 8/2000 | Vasudeva | 206/349 |
| 6,585,942 | B1 * | 7/2003 | Bussell et al. | 206/349 |
| 6,840,376 | B2 * | 1/2005 | Chen | 206/349 |

* cited by examiner

*Primary Examiner*—Luan K Bui
(74) *Attorney, Agent, or Firm*—Modiano & Associati; Albert Josif; Baniel J. O'Byrne

(57) ABSTRACT

A portable container, particularly for professional equipment and instruments, comprising a first half-shell and a second half-shell, which are mutually associated so as to form at least one compartment for containing and protecting equipment and instruments, at least one of the first and second half-shells comprising, along at least one of the internal lateral walls, a distribution of receptacles for respective fixing brackets for at least one support for instruments and equipment, each one of the brackets being provided with locking devices for removable locking within the receptacle and with elements for detachable connection to the support.

10 Claims, 2 Drawing Sheets

PORTABLE CONTAINER PARTICULARLY FOR PROFESSIONAL EQUIPMENT AND INSTRUMENTS

The present invention relates to a portable container, particularly for professional equipment and instruments.

BACKGROUND OF THE INVENTION

Manually portable containers, such as cases, trunks or the like, are used frequently to accommodate permanently professional equipment or instruments of any kind and assigned to any application; said instruments can be, among others, mechanical, electrical or electronic, and are usually suitable to perform operations such as maintenance, monitoring, programming of devices, apparatuses, systems or others.

Typically, the assigned technician or operator in fact carries with him this case and uses, so to speak on the field, the instrument or equipment accommodated permanently in said case, without having to remove it therefrom (for example by providing connections with cables between the instruments in the case and the apparatus on which an intervention is to be carried out in order to perform maintenance or others).

Said instruments are usually fixed on a plate-like support, which is locked within one of the two half-shells of the case. First of all, therefore, since said support must be removable in order to be able to perform maintenance of the instruments, it is necessary to ensure good watertightness and tightness against impurities of the connection between said support and the half-shell (the case should in fact be usable even in prohibitive environmental conditions).

Secondly, however, the need to provide a satisfactory seal must be reconciled with the need to instead be able to remove the support rapidly and easily so as to perform said instrument maintenance operations without an excessive expenditure of time.

SUMMARY OF THE INVENTION

The aim of the present invention is to meet the mentioned requirements, by providing a portable container particularly for professional equipment and instruments, which is characterized by a effective seal against water and impurities between the support of the instruments and the compartment that accommodates it.

Within this aim, an object of the present invention is to provide a portable container particularly for professional equipment and instruments in which the support for the equipment and instruments can be removed simply and rapidly in order to perform maintenance and other operations.

Another object of the present invention is to provide a portable container that is simple, relatively easy to provide in practice, safe in use, effective in operation, and has a relatively low cost.

This aim and these and other objects that will become better apparent hereinafter are achieved by the present portable container, particularly for professional equipment and instruments, of the type comprising a first half-shell and a second half-shell, which are mutually associated so as to form at least one compartment for containing and protecting equipment and instruments, characterized in that at least one of said first and second half-shells comprises, along at least one of the internal lateral walls, a distribution of receptacles for respective fixing brackets for at least one support for instruments and equipment, each one of said brackets being provided with means for removable locking within said receptacle and with elements for detachable connection to said support.

BRIEF DESCRIPTION OF THE DRAWINGS

Further characteristics and advantages of the invention will become better apparent from the following detailed description of a preferred but not exclusive embodiment of a portable container particularly for professional equipment and instruments according to the invention, illustrated by way of non-limiting example in the accompanying drawings, wherein.

DESCRIPTION OF THE PREFERRED EMBODIMENTS

In the example of embodiment that follows, individual characteristics may actually be interchanged with other different characteristics that exist in other examples of embodiment.

Moreover, it is noted that anything found to be already known during the patenting process is understood not to be claimed and to be the subject of a disclaimer.

Figure 1:
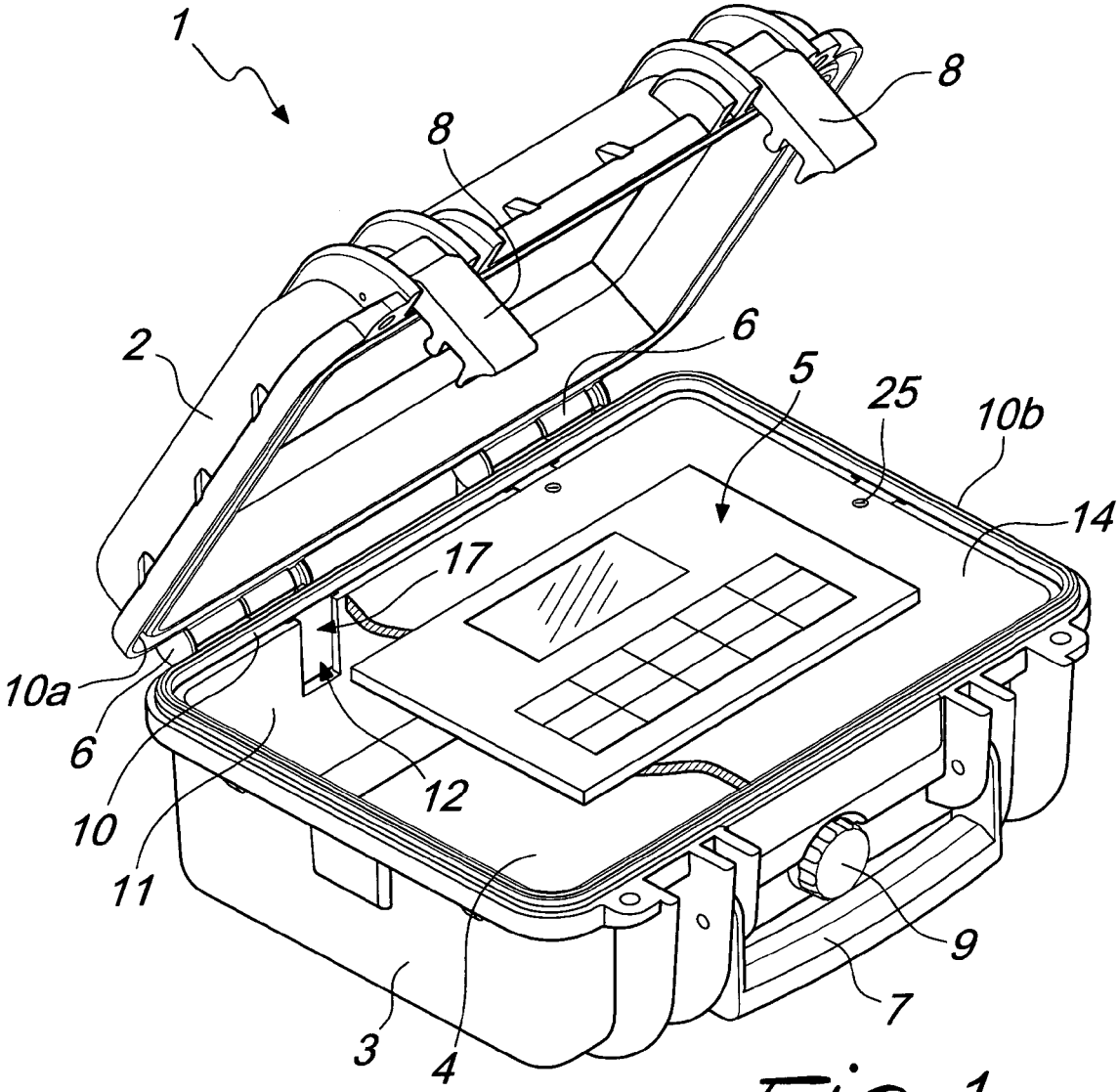
FIG. 1 is a partially sectional perspective view of the portable container according to the invention.

With reference to FIG. 1, the reference numeral 1 generally designates a portable container particularly for professional equipment and instruments according to the invention. The detailed description that follows considers, merely by way of example, a container 1 constituted by a case of relatively reduced dimensions: however, the inventive concept can be applied to other containers having an equivalent functionality but a different nature and dimensions, such as for example trunks, carriers or the like.

Figure 2:
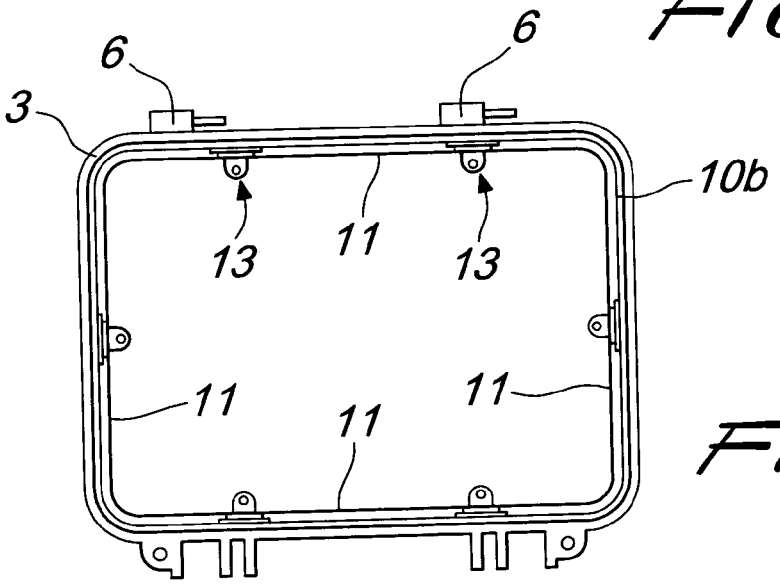
FIG. 2 is a detail plan view of said container in the open condition.

The case described and shown in FIGS. 1 and 2 is of the type that comprises a first half-shell 2 and a second half-shell 3, which are mutually associated so as to form a compartment 4 for accommodating and protecting general generic instruments and equipment, generally designated by the reference numeral 5. The instruments and equipment 5 can be equally of the mechanical, electrical, electronic or other type and are designed to be used without being removed from said container.

As shown in FIG. 1, the first half-shell 2 and the second half-shell 3 are mutually articulated at a pair of hinges 6; further, the container is provided with an external grip handle 7 and with locks 8, 9 for closing the half-shells 2, 3, which mutually mate at the respective perimetric edges 10.

At the perimetric edges 10, the half-shells 2, 3 form respectively a perimetric groove 10*a* and a perimetric ridge 10*b*, the cross-sections of which are substantially complementary to each other and are thus suitable to provide the hermetic closure of the two half-shells 2, 3 against each other (preferably also with the aid of special gaskets).

According to the invention, the first half-shell 2 and/or the second half-shell 3 comprises, along at least one of the internal lateral walls 1, a distribution of receptacles, each designated generally by the reference numeral 12, for respective brackets, each designated by the reference numeral 13, which are suitable for fixing at least one support 14 for the instruments 5 and on which said instruments are mounted. In FIGS. 1 and 2, the receptacles 12 are provided conveniently along the internal lateral walls of the second lower half-shell 3, for reasons of convenience and practicality in accommodating the instruments 5. Moreover, the receptacles 12 for the brackets 13 are provided preferably along all the side walls 11 of the second half-shell 3, so as to provide optimum and balanced fixing of the support 14.

Figure 4:
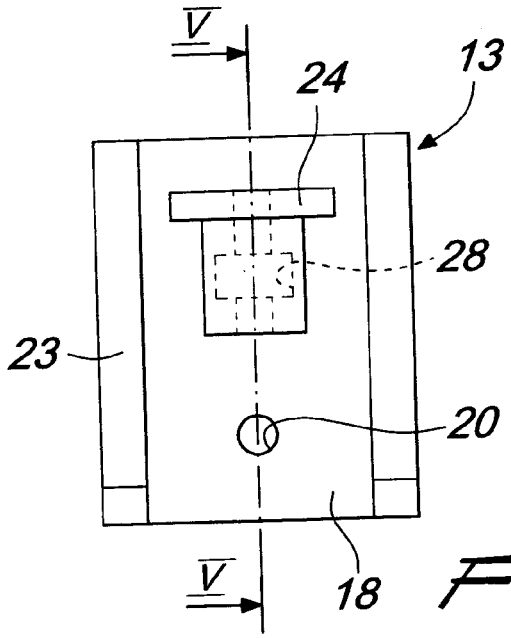
FIG. 4 is a detail front view of a bracket.
Figure 5:
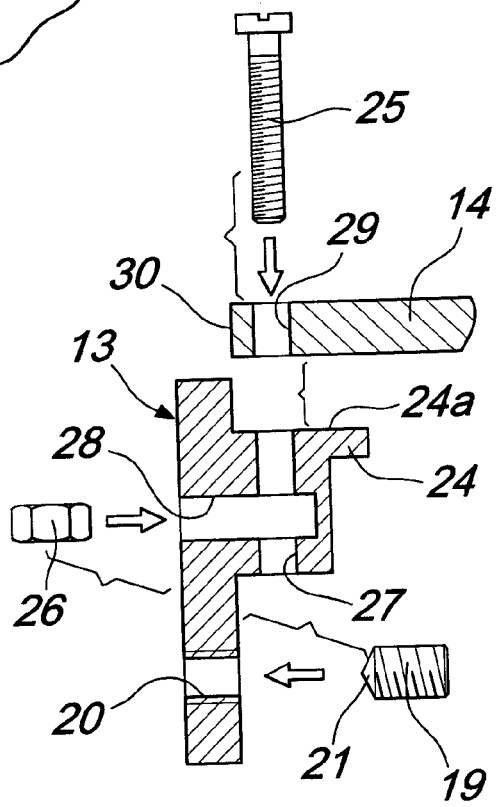
FIG. 5 is an exploded sectional view of said bracket, taken along the line V-V of FIG. 4.

Conveniently, each one of the brackets 13, preferably made of a synthetic material such as plastics, is provided with means for detachable locking within the receptacle 12, said means being generally designated by the reference numeral 15; each one of the brackets 13 is further provided with elements for detachable connection to the support 14, which are generally designated by the reference numeral 16 (FIGS. 4 and 5).

According to the invention, the receptacles 12 are open at the edge 10 of the second lower half-shell 3 and thus allow advantageously to position the support 14 substantially flush with said edge 10, providing the hermetic closure of the compartment 4: it is in fact important that water, dirt and impurities do not penetrate said compartment due to the frequent presence therein of delicate electrical or electronic components.

Figure 3:
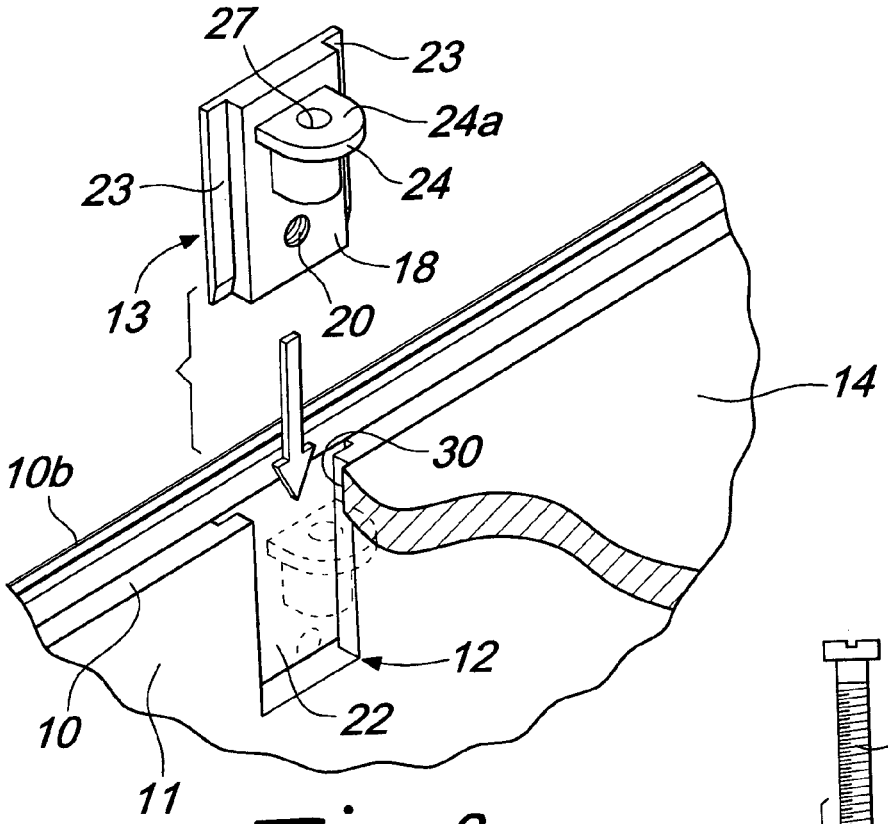
FIG. 3 is a detail perspective view of a receptacle and of the respective bracket.

Conveniently, the receptacles 12 and the brackets 13 have mutually substantially complementary transverse cross-sections, so as to provide between them a sliding coupling (with suitable play) in a direction that is parallel to the internal lateral walls 11 of the second half-shell 3 (i.e., at right angles to the bottom of the compartment 4); when the bracket 13 is inserted in the receptacle 12, movements of the bracket 13 with respect to the receptacle 12 along any other direction other than the sliding direction are prevented. In particular, each bracket 13 and each receptacle 12 have a transverse cross-section that is substantially shaped like a flattened letter T, as shown in FIG. 3; further, each receptacle 12 is conveniently open onto the containment compartment 4 and in fact forms a substantially rectangular window 17 in which the narrower central portion 18 of the bracket 13 (discontinuous portion in FIG. 3) is intended to engage.

The means 15 for detachably locking each bracket 13 within the respective receptacle 12 conveniently comprise at least one grub screw 19, which is engaged in a respective threaded through hole 20 provided in the central portion 18 of the bracket 13 (FIGS. 4 and 5). The grub 19 is suitable to abut, with its end 21, against the internal surface 22 of the receptacle 12 so as to produce, by being screwed in, the friction-induced retention of the bracket 13 against the receptacle 12 along the lateral side walls 23, preventing its spontaneous disengagement.

Advantageously, the elements 16 for detachably connecting each bracket 13 to the support 14 comprise (FIGS. 4 and 5) a sort of ledge 24, which forms an upper surface 24*a*, which protrudes from the bracket 13 substantially in the direction of the compartment 4 for accommodating the instruments 5, and at least one screw 25, which is suitable to fix the support 14 to the bracket 13 by means of a respective nut 26. In greater detail, the ledge 24 is affected by a cylindrical through hole 27, which has an axis of symmetry that is substantially perpendicular thereto, and by a central hollow 28, which affects the cylindrical hole 27 and is open onto the rear face of the bracket 13.

The screw 25 engages, as shown in FIG. 5, a respective hole 29 provided in the support 14, in the cylindrical through hole 27 and finally in the nut 26, which is accommodated beforehand in the hollow 28: the support 14 is consequently fixed rigidly to the bracket 24 on the surface 24*a* by simply tightening the screw 25, an operation which is evidently extremely quick and simple.

Conveniently, the support 14 for instruments 5 is constituted by a substantially quadrangular thin plate, which is made for example of metallic material and is affected by a distribution of holes 29, which are arranged peripherally and have a diameter that allows to insert respective screws 25. The support 14 forms a perimetric edge 30, which substantially mates with the internal lateral walls 11 of the compartment 4 at the edge 10, so that the upper surface of the support 14 is arranged perfectly flush with the edge 10. The support 14, however, may evidently have any shape, as long as it is compatible with the dimensions and geometry of the compartment 4.

The method of use of the portable container according to the invention is fully intuitive. In particular, use of the container is particularly practical and easy whenever it is necessary to perform maintenance on the instruments 5 contained in the compartment 4: it is in fact sufficient to remove the screws 25 from the brackets 13. The locking means 15 further allow to position the support 14 at the chosen height with respect to the edge 10 of the lower half-shell 3 simply by acting on the grub screws 19.

It has thus been shown that the invention achieves the intended aim and objects. The fixing of the support 14 of the instruments 5 has an excellent seal against water and impurities by way of the precise and accurate positioning of said support with respect to the edge 10, said positioning allowing to also achieve a result that is certainly aesthetically pleasant. At the same time, however, as mentioned, the support 14 can be removed rapidly and easily at any time without compromising the integrity and functionality of the portable container.

The invention thus conceived is susceptible of numerous modifications and variations, all of which are within the scope of the appended claims.

All the details may further be replaced with other technically equivalent ones.

The embodiment of the present invention shall be carried out in the most scrupulous compliance with the statutory and regulatory provisions related to the products of the invention or correlated thereto and following any required authorization of the corresponding competent authorities, with particular reference to regulations related to safety, environmental pollution and health.

In practice, the materials used, as well as the shapes and the dimensions, may be any according to the requirements without thereby abandoning the scope of the protection of the appended claims.

The disclosures in Italian Patent Application No. B02004A000574 from which this application claims priority are incorporated herein by reference.

What is claimed is:

1. A portable container for professional equipment and instruments, comprising a first half-shell and a second half-shell having internal lateral walls, said first and second half-shells being mutually associated so as to form at least one containment compartment for containing and protecting equipment and instruments; wherein at least one of said first half-shell and said second half-shell comprises: a distribution of receptacles arranged along at least one of the internal lateral walls thereof; at least one support for instruments and equipment; and fixing brackets for fixing said at least one support to said receptacles; and wherein each bracket of said fixing brackets is provided with removable locking means for removable locking the bracket within a receptacle of said receptacles and with connection elements for detachable connection of the bracket to said support.

2. The container of claim 1 arranged lying flat with the second half-shell in a lower position as a second lower half-shell, wherein said receptacles are arranged on at least one of the internal lateral walls of the second lower half-shell open upward at an upper edge of said at least one of the internal lateral walls of said second lower half-shell, so as to allow to position said at least one support with an upper surface thereof substantially flush with said upper edge, providing a hermetic closure of said containment compartment.

3. The container of claim 2, wherein said brackets and said receptacles have mutually substantially complementary transverse cross-sections, so as to provide therebetween respective couplings which allow sliding in an upward-downward direction that is parallel to said at least one of the internal lateral walls of said second half-shell, said couplings being suitable to prevent movement of said brackets with respect to said receptacles along other directions.

4. The container of claim 2, wherein said brackets and said receptacles have a substantially T-shaped transverse cross-section, said receptacles being substantially open onto said containment compartment so as to form accommodation windows.

5. The container of claim 3, wherein said removable locking means comprises for each one of said brackets at least one grub screw, which is engaged in a respective threaded through hole provided in a said bracket, said at least one grub screw being suitable to abut, with its end, against an internal surface of the receptacle in which said bracket is locked so as to provide, by screw coupling, a friction-induced retention of the bracket against said receptacle along lateral side walls thereof.

6. The container of claim 3, wherein said connection elements of each bracket comprises a ledge, which forms an upper surface that protrudes from the bracket toward said containment compartment, and at least one screw and a respective nut, said at least one screw being suitable to fix, together with the respective nut, said at least one support to said bracket.

7. The container of claim 6, wherein said ledge is provided with a cylindrical through hole, whose axis is substantially perpendicular thereto, and with a central hollow, which intersects said cylindrical hole, said at least one screw being suitable to engage coaxially within a respective hole provided in said at least one support, within said cylindrical through hole, and within said nut accommodated in said hollow, so as to fix said at least one support to said brackets.

8. The container of claim 7, wherein said at least one support for instruments and equipment is constituted by a substantially quadrangular thin plate, which is provided with a distribution of perimetric holes suitable each for insertion of a said at least one screw.

9. The container of claim 4, wherein each one of the internal lateral walls of said first and second half-shells forming said containment compartment is provided with at least one of said receptacles.

10. The container of claim 1, wherein said brackets are made of a synthetic material comprising plastic.

* * * * *